US005704772A

United States Patent [19]

Breslin

[11] Patent Number: 5,704,772

[45] Date of Patent: Jan. 6, 1998

[54] CONTROLLER LESS RESILIENT BLADDER PUMP FOR REDUCED DIAMETER CASING WITH LONG CYCLE

[76] Inventor: Michael K. Breslin, 149 Shelley Dr., Mill Valley, Calif. 94941

[21] Appl. No.: 554,380

[22] Filed: Nov. 8, 1995

[51] Int. Cl.[6] ..... F04B 43/00

[52] U.S. Cl. ..... 417/478; 417/480

[58] Field of Search ..... 417/413.1, 478, 417/480, 384, 385, 379

[56] References Cited

U.S. PATENT DOCUMENTS

| | | | |
|---|---|---|---|
| 4,701,107 | 10/1987 | Dickinson et al. | 417/478 |
| 4,749,337 | 6/1988 | Dickinson et al. | 417/394 |
| 4,808,084 | 2/1989 | Tsubouchi et al. | 417/478 |

FOREIGN PATENT DOCUMENTS

| | | |
|---|---|---|
| 56-009679 | 4/1981 | Japan . |
| 59-068578 | 8/1984 | Japan . |

*Primary Examiner*—Timothy Thorpe
*Assistant Examiner*—Samantha H. Moon
*Attorney, Agent, or Firm*—Townsend and Townsend and Crew, LLP

[57] ABSTRACT

A conventional vibrator for actuating small diameter pump is tapped at the small volume pressure chamber and communicated to a plugged, elongate hose, thus expanding the actuating pressure chamber of the vibrator conveniently to virtually any required volume within the small casing environment. With the expanded pressure chamber, cycle period of the vibrator can be extended to virtually any desired time cycle without performance limiting closure of the needle valve regulator. An elongate bladder forms the periodic pressure actuated positive displacement volume for the pump. By increased length of the bladder, correspondingly increased cycle pumping volume is provided for the pump. At the same time, bladder expansion provides sufficient pump inlet pressure to enable the use of free floating check valves. A high volume, slow cycle pump for the narrow casing environment results.

3 Claims, 2 Drawing Sheets

CONTROLLER LESS RESILIENT BLADDER PUMP FOR REDUCED DIAMETER CASING WITH LONG CYCLE

This invention relates to positive displacement pumps for placement at the bottom of small diameter well casings, in the order of two inches, such as those used in the environmental remediation industry. More specifically, a controllerless collapsible bladder pump is disclosed having long cycle with relatively high volume output.

BACKGROUND OF THE INVENTION

Vibrator actuated diaphragm pumps are known. In such pumps, a vibrator produces a periodic diaphragm collapsing pump discharge. After the diaphragm collapsing pump discharge, the vibrator relieves the pressure on the diaphragm, and a spring within the diaphragm expands the diaphragm to receive the next positively displaced volume of fluid for discharge. With each cycle of the vibrator, the above described pumping cycle is repeated. One such pump is produced by XITECH of Rio Rancho, N. Mex.

A bladder pump using a vibrator without an external cycle time extender was produced by this inventor and is available through Clean Environment Equipment in Oakland, Calif.

The vibrators actuating such pumps are well known. Typically, they contain a small reservoir (in the order of one cubic inch capacity) for containing compressed air. A throttle valve of the needle variety adjustably controls the inflow of air to the pressure chamber. Conventional valving supplied to the vibrator produces periodic diaphragm collapsing air flow from the vibrator chamber at a frequency dependent upon needle valve setting. All conventional cycling of such vibrators are extremely short; hence the name "vibrator" is descriptive of the operation of such pump-actuators.

I have determined that such pumps are generally not suitable for the small casing diameter environment. The reader will understand that the following reported deficiencies constitute part of this invention disclosure. At least a part of the invention herein is the understanding of the problem to be solved.

First, and in the small diameter casing environment, the pumping volume of the diaphragm for a discrete valve cycle is limited by the diameter of the casing. Only extremely small volumes (on the order of less than an ounce) of fluid are moved with each cycle.

Second, and in part because of the presence of the spring on the fluid side of the diaphragm (to return it to its original position after compressed air has pushed it against the spring during the fluid-discharge cycle), such pumps are relatively easily clogged by debris lodging between the diaphragm and spring.

Third, the action of the spring in opening the diaphragm after pumping collapse must have sufficient pressure to actuate the required pump check valves. If spring closed check valves are required, such spring closed check valves are in themselves subject to clogging.

Fourth, this required actuating spring expanding of the diaphragm is limiting on the operational pressure ranges that the pump can tolerate. The spring must produce sufficient pressure on the diaphragm to assist check valve opening.

Fifth, as the name implies, conventional actuating "vibrators" used to drive diaphragm pumps have short cycles. They are generally not suitable for longer cycle operation. These short cycles again limit pumping capacity for each discrete pump cycle.

Finally, in many instances low flow of fluid is required. For such cases the pump, must cycle slowly (on the order of once every 5 to 60 minutes). If the pump does not cycle slowly it can run dry and waste energy in the cycling without pumping fluid. Attempts to obtain long cycles from conventional vibrator-driven pumps require throttling of such throttle valves almost to the state of complete closure. At this state of near closure, the small gap in the throttle valve becomes very sensitive. Changes in humidity, temperature, and pressure can and do cause alteration to the adjusted (long length) cycle. Further, complete pump stoppage sometimes results.

Given the above, the most reliable and efficient pump that would work within a small well casing would be one that incorporated both the ability to deliver a high flow rate when needed and one that could reliably pump a very small amount of fluid when little fluid was available.

After considering the above deficiencies, I have arrived at the disclosure herein.

SUMMARY OF THE INVENTION

A conventional vibrator for actuating small diameter pump is tapped at the small volume pressure chamber and communicated to a plugged, elongate hose, thus expanding the actuating pressure chamber of the vibrator conveniently to virtually any required volume within the small casing environment. With the expanded pressure chamber, cycle period of the vibrator can be extended to virtually any desired time cycle without performance limiting closure of the needle valve regulator. An elongate bladder forms the periodic pressure actuated positive displacement volume for the pump. By increased length of the bladder, correspondingly increased cycle pumping volume is provided for the pump. At the same time, bladder expansion provides sufficient pump inlet pressure to enable the use of free floating check valves. A high volume, slow cycle pump for the narrow casing environment results.

DESCRIPTION OF THE PREFERRED EMBODIMENT

Figure 1:
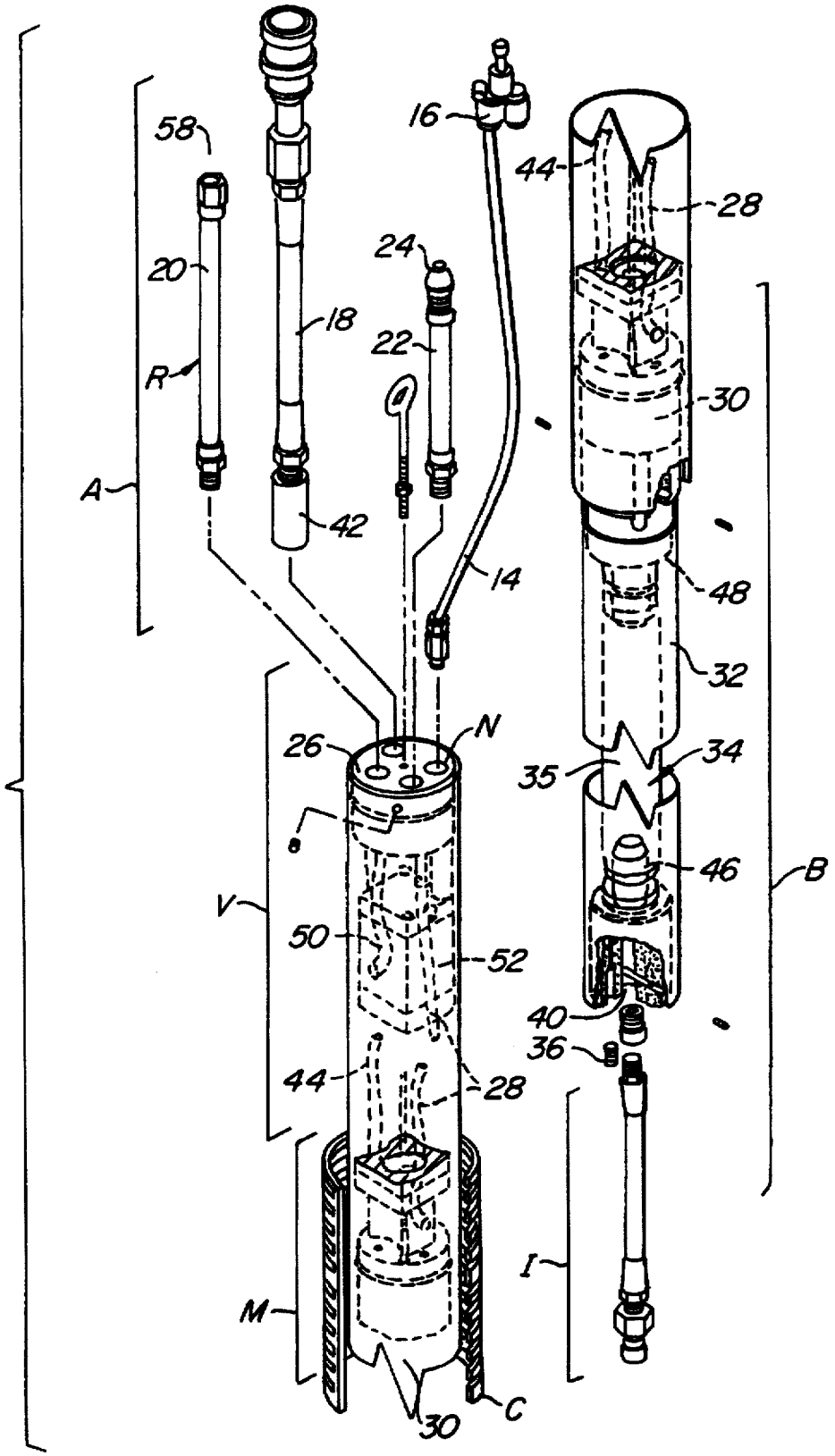
FIG. 1 is an exploded view of the pump of this invention.

Referring to FIG. 1, the discrete sections of the exploded pump can be understood.

First, the reader will understand that the entire pump is mounted within casing C. Although casing C is only partially shown in FIG. 1, it will be understood that the pump normally resides in a small diameter casing having a total diameter of two (2) inches or less.

Secondly, the exploded view of FIG. 1 can be divided into discrete sections. These sections include air and product hose assembly A, vibrator cap and sleeve assembly V, vibrator mount assembly M, bladder assembly B, and inlet or product inlet hose assembly I. It will be understood that all of these discrete sections of the pump are contained within casing C.

Referring to air and product hose assembly A and vibrator cap and sleeve assembly V, the hose connections can be understood. Air discharge from the pump occurs through air discharge vent or line 14 to U-fitting 16. U-fitting 16 directs discharged air downward to prevent personnel attending the open and discharge end of casing C for being sprayed with air and fluid exhaust.

Product discharged from the pump is discharged through outlet or discharge conduit 18 (here shown in exploded unassembled relation). Expanded air reservoir section 20 form the extension to reservoir R contained within vibrator 52 (this expanded air reservoir section 20 likewise being shown exploded). Finally, air inlet hose assembly 22 is shown with male quick connect fitting 24. Further portions of the air inlet will not be shown.

Air inlet hose assembly 22 passes through pump cap 26 to air conduit 28 to vibrator base 30. Air then passes upward of vibrator 52 being regulated in rate of air flow at needle valve N (shown partially hidden behind air inlet hose assembly 22). It will be observed that needle valve N has an upwardly disposed valve stem so that convenient screw driver adjustment can be made through exhaust hose fitting 58 and through pump cap 26 without disassembling the pump.

Vibrator 52 is conventional. It may be purchased from the ARO Company of Bryant Ohio under the designation number 59890. This model of vibrator comes with an ambient compressed air reservoir having a capacity of about $1^3$ (one cubic inch). With such a reservoir, vibration at a rate of between 10 and 100 cycles per minute are normally obtainable. With the expanded air reservoir section 20, cycling rates on the order of 0.01 to 10 per minute (1 to 600 per hour) can be obtained. This results in both a fast cycle rate for high flow and a low cycle rate for low flow.

Air discharges through vibrator base 30 into bladder casing 32. Bladder casing 32 has collapsible bladder 34 having resilient collapsible wall 35 fully contained. The annular space between the casing 32 and the bladder 34 is open to air discharged from vibrator 52 at through vibrator base 30 at the top, and closed at plug 36 at the bottom.

It is required that bladder assembly B at collapsible bladder 34 have check valving. Accordingly, free floating ball check valve 40 is at the bottom of collapsible bladder 34. Likewise, free floating ball check valve 42 is at the top of collapsible bladder 34. Connection between the top portion of collapsible bladder 34 to free floating ball check valve 42 occurs through discharge vent or conduit 44.

Having set forth this much, pump operation can be readily understood. When collapsible bladder 34 is compressed by the introduction of compressed air into the annular space between bladder casing 32, and bladder 34, free floating ball check valve 40 will close and free floating ball check valve 42 will open. Discharge of pumped product will occur through discharge conduit 18.

When pressure is relieved interior of bladder casing 32, collapsible bladder 34 will expand, creating a negative partial pressure inside bladder 34. Free floating ball check valve 42 will close and free floating ball check valve 40 will open. Inlet of pumped product will occur to the interior of collapsible bladder 34. Cyclical repeat of the outlet and inlet will occur dependent upon the cycle rate of vibrator 26.

Having set forth both the general construction of the pump and the general operation of the pump, the effect of expanded air reservoir section 20 can now be understood.

First, at air and product hose assembly A, placement of an expanded reservoir for timing air in the pump cap 26 or elsewhere in the pump would not normally be practical due to the presence of air discharge line 14, discharge conduit 18, and air inlet hose assembly 22 and the confines of the small casing C in which the pump must reside. By placing the expanded reservoir volume interior the hose sealed at the end, the volume of the reservoir can be expanded at will as long as sections of hose can be added. Thus, vibrator 52 can have a very large volume—even though it is effectively confined within casing C.

Secondly, the expanded volume provided by expanded air reservoir section 20 enables needle valve N to be set at operable flow rates. It is not required that needle valve N be set to the almost closed disposition for cycle times longer than 6 seconds where changes in humidity, condensed drops of vapor, or even air borne debris can either cause intermittent operation or complete clogging of needle valve N.

Thirdly, it will be seen that just as expanded air reservoir section 20 is resilient elongate bladder 34 and bladder casing 32 are likewise expansible. Presuming that it is desired that each discrete cycle of the pump discharge large volumes of fluid, expansion of these portion of the pump to virtually any desired length along casing C can occur.

Regarding the case of the collapsible bladder 34 and bladder casing 32, it is important to consider the impact of expanded air reservoir section 20 on the operation of vibrator 52. Presuming that both collapsible bladder 34 and bladder casing 32 are extended—say to 10 feet in length—an extremely slow cycle would be desired from vibrator 52. Such a slow cycle would permit sufficient air flow to pass interior of bladder casing 32 and about collapsible bladder 34 to enable substantially complete collapse and subsequent expansion of collapsible bladder 34. In this case, expanded air reservoir section 20 would receive a correspondingly large volume used with shorted pumps as a way of conserving energy in low-flow situations.

It is to be understood that using the mechanics of this disclosure, we have generated relatively long cycle times. For example, utilizing expanded air reservoir section 20, Fifty feet in length, we have achieved a pump cycle as long as 1 cycle per hour (0.016 cycles per minute) with complete discharge from the interior of collapsible bladder 34.

Over the diaphragm pump of the prior art, an important advantage of collapsible bladder 34 can be set forth. Both the prior art diaphragm pump and collapsible bladder 34 require certain "dead space" in any pump construction. For example, it will be observed that collapsible bladder 34 mounts to lower collapsible bladder mount 46 at the bottom and upper collapsible bladder mount 48 at the top. These respective lower collapsible bladder mount 46 and upper collapsible bladder mount 48 prevent full collapse of collapsible bladder 34 and the inside areas of bladder 34 adjacent to mounts 48 and 46 and the interior conduits of mounts 48 and 46 constitute "dead space".

It will be observed that as collapsible bladder 34 lengthens, the ratio of the dead space of bladder 34 adjacent to mounts 48 and 46 and interior conduits in mount 46 and upper collapsible bladder mount 48 to the total length of collapsible bladder 34 improves. In short, the longer collapsible bladder 34, the greater percentage portion of collapsible bladder 34 utilized in useful pumping. Improved pump efficiency results.

It will be understood that modification of the preferred embodiment set forth here can occur. For example, free floating ball check valve 40 could be moved closer to the interior of collapsible bladder 34.

The practical advantage of the disclosed design can be readily understood. First, and in the small diameter casing environment, the pumping volume of the bladder is not limited by the diameter of the casing. Large volumes of liquid can be moved with each cycle.

Second, and in part because of the absence of any spring interior of the collapsible bladder, such pumps are not relatively easily clogged by debris.

Third, the action of the bladder in opening after pumping collapse must has sufficient pressure to actuate the free floating ball check valves. Spring closed check valves are not required. Free floating ball check valves can be used which have high resistance to clogging.

Fourth, the conventional actuating "vibrators" used to drive diaphragm pumps is now provided with a long, regulated cycle of up to and exceeding one cycle per hour. The pumping capacity is not limited by vibrator cycle.

Finally, needle valve N can operate in positions that allow continuous and reliable flow rates of air through it. Changes in humidity, temperature, and pressure do not cause substantial alteration to the adjusted (long length) cycle. Complete pump stoppage is avoided.

Figure 2:
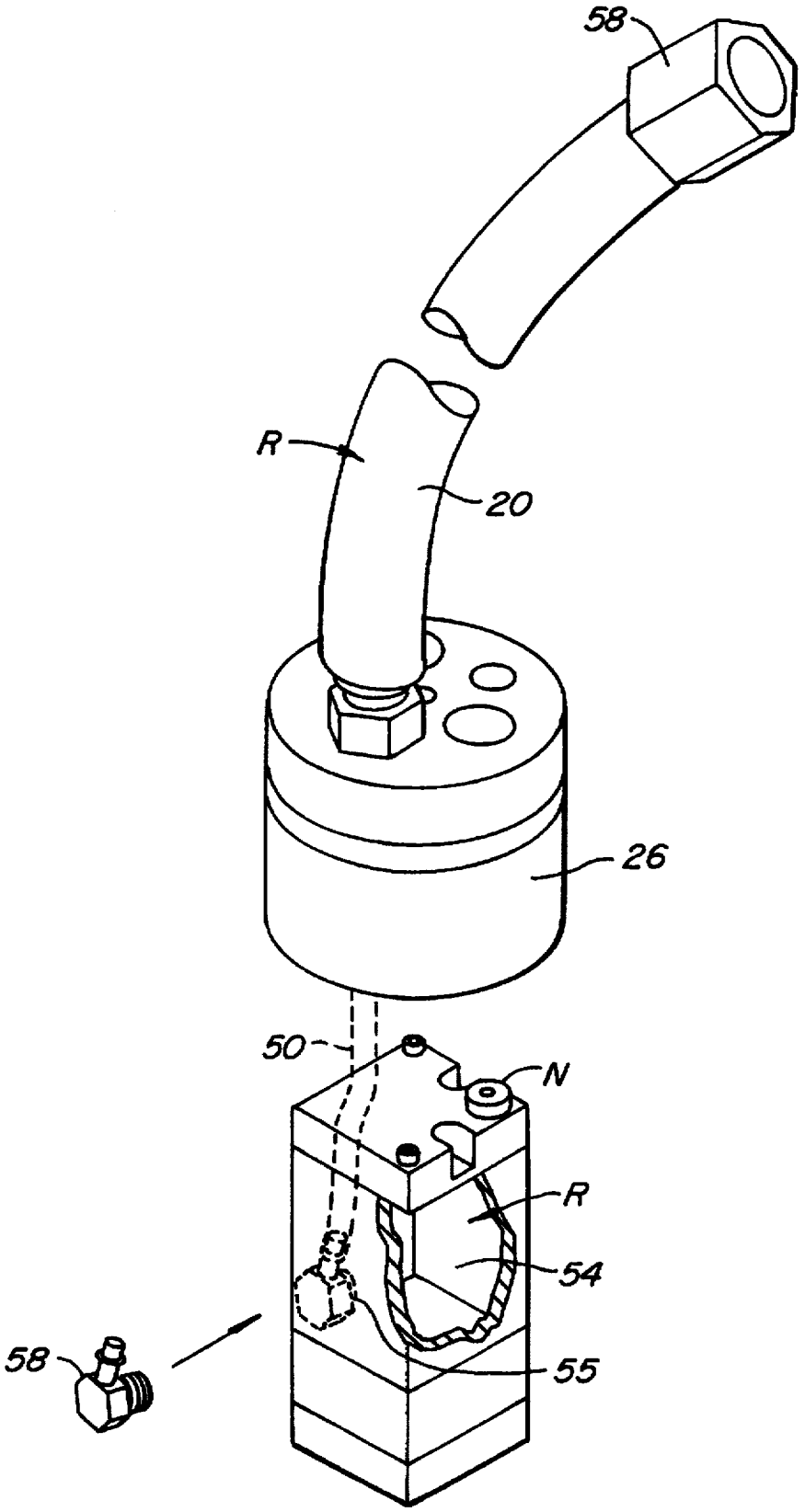
FIG. 2 is a side elevation taken through the side of a conventional vibrator illustrating the conventional pressure chamber, the tap communicated to the chamber, and showing a partial view of the hose extended air reservoir for producing an extended cycle to the vibrator.

Referring to FIG. 2, what is shown is a view of vibrator 52 with timing extension tube 50 connected to a barb connector 62 which is fitted through a wall at tap 55 in vibrator 52 to provide a passage to the interior pressurizing chamber 54. The timing extension tube 50 connects through pump cap 26 to expanded air reservoir section 20. Expanded reservoir section 20 is closed at the opposite end with a hose plug 58.

What is claimed is:

1. In a casing mounted pump having a pump inlet toward a bottom of the casing for receiving fluid to be pumped, a pump outlet to a top of the casing for discharging pumped fluid, the pump including, a pump casing;

a bladder casing within the pump casing for containing periodic pressurization;

a collapsible bladder within the bladder casing having an inlet communicated to the pump inlet, an outlet communicated to the pump outlet, a resilient collapsible wall about an enclosed interior for collapsing the collapsible bladder responsive to pressure between the collapsible bladder and the bladder casing; and, a vibrator having a compressed air inlet, a pressurizing chamber, and an air discharge vent for periodically discharging air to and from the bladder casing within the pump casing for expanding and collapsing the collapsible bladder for pumping fluid to and from the enclosed interior of the collapsible bladder;

the improvement to the pump comprising:

a tap through the vibrator for connecting the pressurizing chamber of the vibrator to an air reservoir exterior of the vibrator; and, a conduit within the pump casing communicated to the tap and closed at an end for forming an expanded chamber for the air reservoir.

2. In a casing mounted pump according to claim 1 and wherein:

the collapsible bladder comprises a resilient elongated bladder within the bladder casing.

3. In a casing mounted pump having a pump inlet toward a bottom of the casing for receiving fluid to be pumped, a pump outlet to a top of the casing for discharging pumped fluid, the pump including, a pump casing;

a bladder casing within the pump casing for containing periodic pressurization;

a collapsible bladder within the bladder casing having an inlet communicated to the pump inlet, an outlet communicated to the pump outlet, a resilient collapsible wall about an enclosed interior for collapsing the collapsible bladder responsive to pressure between the collapsible bladder and the bladder casing; and, a vibrator having a compressed air inlet, a pressurizing chamber, and an air discharge vent for periodically discharging air to and from the bladder casing within the pump casing for expanding and collapsing the collapsible bladder for pumping fluid to and from the enclosed interior of the collapsible bladder;

the collapsible bladder comprises a resilient elongated bladder within the bladder casing.

* * * * *